United States Patent [19]

Corbett et al.

[11] 4,225,989

[45] Oct. 7, 1980

[54] INFLATABLE SUPPORTS

[75] Inventors: Aubrey E. Corbett, Kenilworth; Siu L. Ho, Coventry; Ronald J. Clark, Sidmouth, all of England

[73] Assignee: Glynwed Group Services Limited, Birmingham, England

[21] Appl. No.: 948,798

[22] Filed: Oct. 5, 1978

[51] Int. Cl.[2] ..... A61G 7/04; A47C 27/10

[52] U.S. Cl. ..... 5/453; 5/455; 5/469; 128/33

[58] Field of Search ..... 5/365, 368, 369, 284, 5/160, 347, 91, 450, 453, 455, 456, 468, 469, 423; 297/DIG. 3, 180; 128/33

[56] References Cited

U.S. PATENT DOCUMENTS

| | | | |
|---|---|---|---|
| 1,371,919 | 3/1921 | Mahony | 5/455 |
| 1,772,310 | 8/1930 | Hart | 5/456 |
| 2,719,986 | 10/1955 | Rand | 128/33 |
| 2,998,817 | 9/1961 | Armstrong | 5/422 |
| 3,148,391 | 9/1964 | Whitney | 5/422 |
| 3,266,064 | 8/1966 | Figman | 5/469 |
| 3,587,568 | 6/1971 | Thomas | 128/33 |

FOREIGN PATENT DOCUMENTS

| | | | |
|---|---|---|---|
| 949652 | 2/1964 | United Kingdom . | |
| 959103 | 5/1964 | United Kingdom | 5/368 |
| 1222710 | 2/1971 | United Kingdom . | |
| 1263418 | 2/1972 | United Kingdom . | |
| 1341325 | 12/1973 | United Kingdom . | |

*Primary Examiner*—Roy D. Frazier
*Assistant Examiner*—Alexander Grosz
*Attorney, Agent, or Firm*—Larson, Taylor and Hinds

[57] ABSTRACT

A ripple bed has an upper and a lower inflatable layer. The upper layer has separate air passages which are independently inflatable and deflatable to provide the rippling effect. The lower layer is separately inflatable to provide support over any area of the upper layer which is deflated.

9 Claims, 5 Drawing Figures

Figure 1:
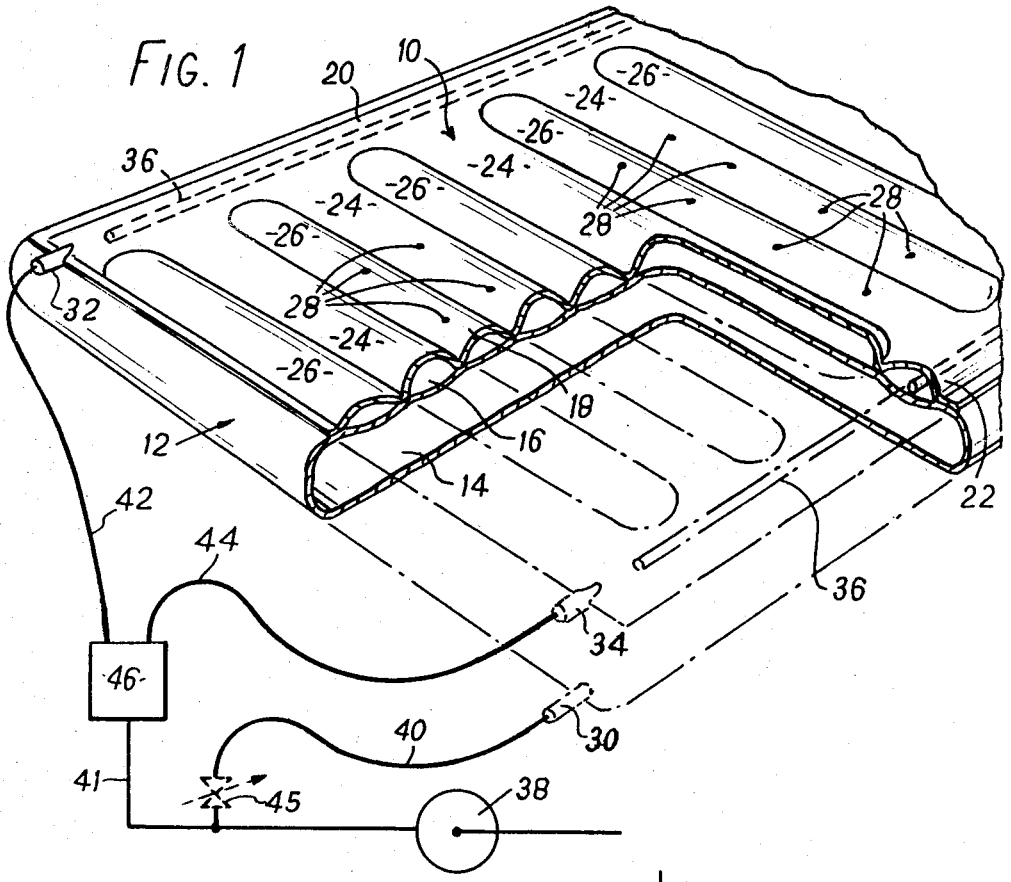

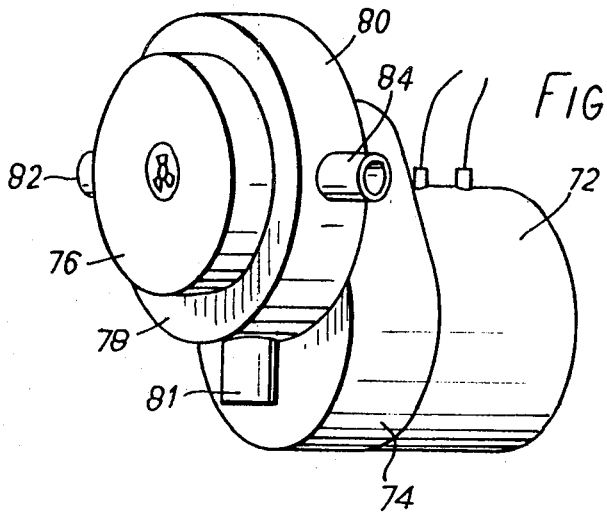
FIG. 4
FIG. 5
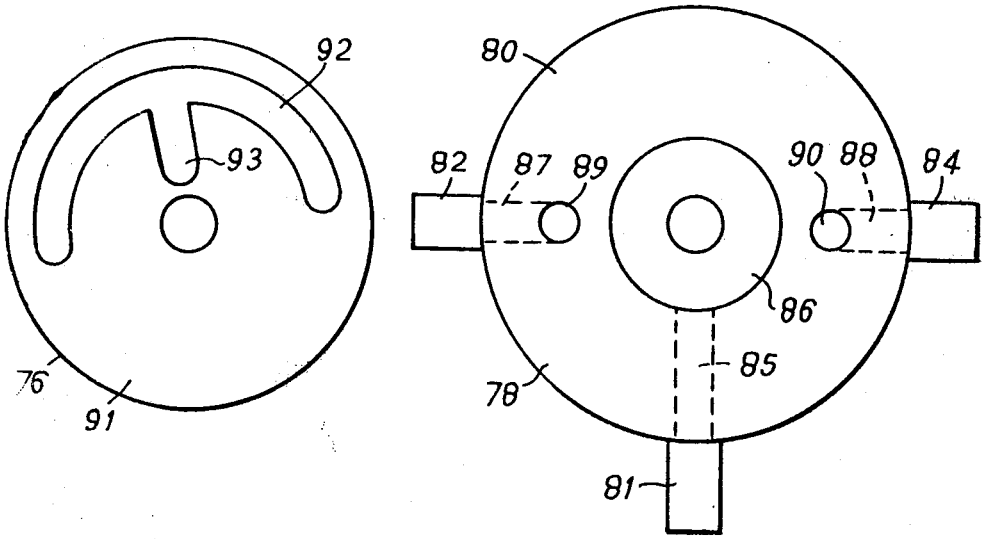

INFLATABLE SUPPORTS

FIELD OF THE INVENTION

This invention relates to inflatable supports, such as air mattresses, and especially ripple beds.

BACKGROUND OF THE INVENTION

In a ripple bed, air is supplied under pressure to two separate air passages in an inflatable mattress. The passages take the form of a series of parallel tubes supplied from common header tubes, one for each passage, located on opposite sides of the mattress. Alternate transverse tubes go to one header tube, and the intervening transverse tube goes to the other header tube. The two passages are inflated and deflated cyclicly, the cycles of the two passages being out of phase so that as one is being inflated the other is being deflated. This creates a ripple effect on the surface of the bed, which has been found particularly useful in helping to prevent bedsores in bed-ridden patients. Leakage of air from the top surface may also be provided to assist in cooling the patient and evaporating moisture. Air beds of this type are for example disclosed in U.S. Pat. Nos. 2,998,817 and 3,653,083 and U.K. Specification No. 949,652.

SUMMARY OF THE INVENTION

The present invention provides an inflatable support comprising an upper and a lower inflatable layer, the upper layer having a plurality of separate air passages which are independently inflatable and deflatable and are distributed over the area of the layer as a series of tubes such that the tubes of different passages are juxtaposed, and a lower separately inflatable layer below the upper layer so that when any portion of the upper layer is deflated a body resting thereon can be supported over the deflated area by the lower inflatable layer. This function of the lower inflatable layer is particularly important during the changeover period when one set of transverse tubes is deflating and the other set has not yet been fully inflated. The lower inflatable layer also provides a soft support to the upper layer which has been found to be a desirable feature.

The upper inflatable layer preferably takes the form of a plurality of our passages, each comprising series of transverse tubes supplied by common header tubes, located at the sides of the support, alternate transverse tubes communicating with one header tube, and intervening transverse tubes communicating with the other header tube. Preferably the upper surface of the upper inflatable layer is of air-permeable material or is provided with air bleed apertures, whereby deflation of a passage can be effected by cutting off the air supply to that passage. Preferably air bleed apertures are provided arranged non-uniformly over the surface to provide air bleeding from selected areas of the surface. The lower inflatable layer may comprise a single inflatable envelope, or alternatively it may be divided by partitions into a number of separately inflatable compartments.

Inflation equipment may also be included with the air bed, comprising a source of compressed gas, suitably air (and referred to herein generally as air), supplying separate conduits to the lower and upper inflatable layers, the conduit to the upper layer branching to the separate inlets of the different passages in the upper layer, and a switching device being provided to cyclicly switch the air supply between the branches. The compressed air supply is perferably provided by a motor driven compressor. The switching device preferably includes means for varying the cycle length. The switching device may comprise a motor driven valve. The motor speed of the valve or compressor is preferably variable so that the air pressure to the support, both the upper and lower layers, can be varied to suit different weights of body supported thereby, and in the case of a variable speed valve the ripple speed can also be varied.

BRIEF DESCRIPTION OF THE DRAWINGS AND DESCRIPTION OF PREFERRED EMBODIMENTS

Figure 3:
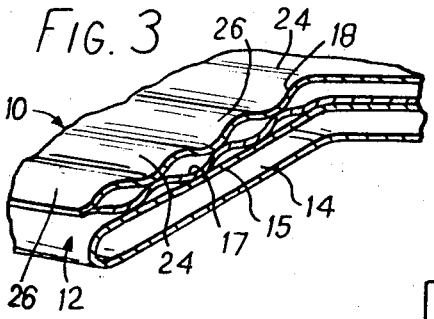
Figure 2:
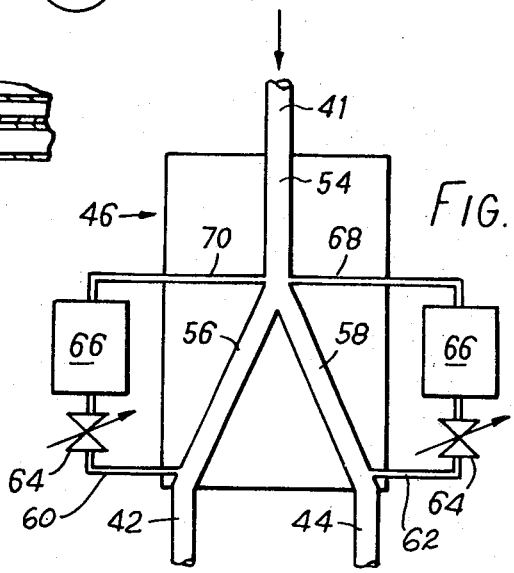

In order that the invention may be more clearly understood, one embodiment will now be described with reference to the drawings, wherein:

FIG. 1 shows a perspective cut-away view of part of a mattress of the invention, and indicates diagrammatically the arrangement of its inflation equipment, FIG. 2 shows diagrammatically one form of timing valve for switching the air flow to alternate passages of the upper inflatable layer, FIG. 3 shows a cut-away portion of a modification to the construction of FIG. 1, FIG. 4 shows a perspective view of a motor-operated valve, and FIG. 5 shows the mating faces of the valve disc and valve body.

Referring to FIG. 1; the mattress is constructed from flexible air-impermeable sheet material, and comprises an upper inflatable layer 10 and a lower inflatable layer 12. The lower inflatable layer is defined by lower and upper sheets 14,16 respectively, while the upper layer is formed from a top sheet 18 peripherally sealed to the sheet 16. The sheets 16,18 are also sealed together within the area defined by the peripheral seal, to provide two lateral tubes 20,22 respectively running down opposite sides of the mattress, and a series of elongated transverse tubes extending between the lateral tubes. The elongated transverse tubes are in two parallel sets 24,26 respectively, the tubes 24 communicating with the lateral tube 20 at one side of the mattress, while the tubes 26 communicate with the lateral tube 22 at the opposite side of the mattress, the upper surfaces of these transverse tubes being convexly curved, taken transverse to the direction of elongation. There are thus defined two separate air passages in the upper inflatable layer between the sheets 16,18, one passage comprising the lateral tube 20 and transverse tubes 24, and the other passage comprising the lateral tubes 22 and the transverse tubes 26. Some at least of the transverse tubes are provided with very small apertures 28, which provide a controlled leak of air from the upper inflatable layer. The lower inflatable layer is provided with an air inlet 30 at a suitable point. If the layer 12 should be constructed to provide a number of separate compartments instead of a single inflatable envelope, then it can be provided with a corresponding number of air inlets. The two air passages of the upper inflatable layer are provided with separate air inlets 32,34 respectively leading into the lateral tubes. Flexible elongate members 36, such as p.v.c. tubing, may be provided so as to extend along the lateral tubes 20,22 to ensure that they are kept open to the passage of air.

For ease of manufacture each inflatable layer could be formed of two separate sheets, as shown in FIG. 3, thus employing a total of four sheets of material. The sheet 16 is thus replaced by two sheets 15,17, the sheet 15 being sealed to the sheet 14 to form the lower inflatable layer and the sheet 17 sealed to the sheet 18 to form the upper inflatable layer. These two intermediate sheets may be interconnected so as to locate the upper layer on the lower layer. However the upper layer may be detachable from the lower layer so that either can be used separately.

The mattress is supplied with compressed air from an electrically driven compressor 38. The compressor preferably has a variable output, suitably by using a variable speed drive motor, so that the air pressure to the mattress can be adjusted to suit different weights of body supported thereon. The outlet from the pump branches, one branch 40 going directly or via a pressure reduction valve, to the inlet of the lower inflatable layer. The other branch 41 leads to a cyclic switch-over valve 46, from which it emerges as further branches 42,44 going to the inlets 32,34 respectively of the two air passages of the upper inflatable layer.

In operation, the lower inflatable layer is kept inflated to the outlet pressure of the compressor (although this could be reduced by a suitable valve or controlled leak if desired.) The air from the compressor is supplied to the upper inflatable layer through first one air passage then the other on an endlessly cyclical basis, for example with each passage being inflated for a period of twenty seconds before switching to the other passage. This switching of the air supply back and forth between the branches 42,44 is effected by the switch-over device 46 which incorporates a timer which periodically switches the valve back and forth. The timer may be of any suitable type. For example, the valve may be cyclicly operated by an electric motor, preferably a variable speed motor so that the cycle frequency can be altered. Electric motors with electronic speed controls are known in the art. Alternatively the switching may be effected electrically by a solenoid or the like at intervals controlled by an electronic timing device of known kind. Another arrangement uses a fluidic astable device such as is shown in FIG. 2.

Referring to FIG. 2, the fluidic astable device, which is a device known in the fluidics art, comprises an air inlet passage 54 which branches to two air outlet passages 56,58, the passages bring arranged in the form of a Y. Inlet passage 54 is connected to the conduit 41 from the compressor 38, while the outlet passages 56,58 are connected to the branch conduits 42,44 respectively. From the outlet passages 56,58 extend two air bleed tubes 60,62 respectively, each of which leads to a variable throttle valve 64 and air chamber 66 in series (although they could be in parallel). From the air chambers 66 extend respective air tubes 68,70 which open into the opposite sides of the inlet passage 54 at the junction with the passages 56,58. In operation, air supplied through the inlet passage 54 can be deflected into one or other of the passages 56,58 by a certain minimum rate of air flowing from the opposite tube 68 or 70. Once air is flowing through one of the outlet passages it will continue to do so until it is flipped over into the other outlet passage by the application of a minimum rate of air issuing from the other tube 70 or 68. The air for the tubes 70,68 is obtained from the bleed tubes 60,62 respectively, so that air passing through one of the outlet passages will provide the air bleed necessary to switch the air flow over to the other passage. The switching process thus cycles automatically, the cycle period being determined by the resistance-capacitance of the throttle 64 and chamber 66 in each air bleed passage. The throttle valves 64 are variable so that the cycle times can be adjusted as desired. Additionally or alternatively the chambers 66 could be adjustable. This type of switching device is simple to construct, and has essentially no moving parts.

An example of a motor operated valve for alternating the supply of air is shown in FIGS. 4 and 5. An electric motor 72 operates through a step-down gear box 74 to rotate a valve disc 76 which is in sliding contact with a face 78 of a valve body 80 which is fixed to the gear box housing. The valve body has radial ports 81,82,84 for connection to the branches 41, 42 and 44 respectively. The inlet port 81 connects through a passage 85 with a central chamber 86 which is open on the face 78 of the valve body. The ports 82,84 connect through respective passages 87,88 with respective diametrically opposed openings 89,90 in the face 78. In its face 91 which contacts the face 78, the valve disc 76 has a semi-annular channel 92 which registers with the openings 89,90, and a radial channel 93 which connects the channel 92 with the chamber 86 in the valve body. Thus, on rotation of the disc 76, air supplied to the chamber 86 passes via the channels 93,92 to the openings 89 and 90 alternately. The disc speed is varied by varying the motor speed (although a variable speed gear box could be used instead). For example, with motor speed varying from 60 to 600 rpm and an appropriate speed reduction in the gear box, a ripple period (i.e. the period from maximum inflation of one set of tubes to maximum inflation of the other set of tubes) of from about seven seconds to about seventy seconds can be obtained.

When the air supply is switched to one of the passages of the upper inflatable layer, the lateral and transverse tubes of that air passage inflate to support a body lying on the mattress. The lateral and transverse tubes of the other passage, now that there is no longer the air supply to that passage, gradually deflate through the loss of air through the apertures 28. This alternate inflation and deflation of the two sets of transverse tubes produces a rippling effect, and prevents continuous pressure being applied to any one part of the body supported on the mattress. Because the lower inflatable layer remains inflated throughout, it will act to support a body on the mattress in the area of either of the air passages of the upper inflatable layer, if that layer should deflate to such an extent that sheet 18 bears on the sheet 16. A variable pressure reduction valve 45 can be provided in the branch 40 to enable the firmness of the underlying support to be varied independently of the support provided by the upper layer. Of course the more firm the lower layer, the more it will support the tubes of the upper layer, further emphasizing the ripple effect.

Although the invention has been particularly described in relation to a mattress, it could be applied to other inflatable supports, such as seat cushions. The switch-over valve device may be capable of being placed in a condition in which both air passages of the upper layer are simultaneously inflated. This may be useful, for example, in making a bed or moving or treating a patient on the bed.

We claim:

1. An inflatable body support comprising an upper inflatable layer and a lower inflatable layer, the upper layer comprising upper and lower surfaces sealed together providing a plurality of separate air passages which are independently inflatable and deflatable and which air passages, taken together, are distributed over the area of the upper layer with each air passage including a series of enlongated tubes, such that the tubes of different air passages are juxtaposed, the upper surfaces of the tubes being convexly curved, taken transverse to the direction of elongation, to present a series of generally parallel curved surfaces which support the body located thereon, said lower inflatable layer being located directly beneath the upper layer and being inflatable separately from the upper layer and continuously over substantially the entire area directly beneath the upper layer, such that the lower layer, when inflated, continuously and directly supports substantially the entire area of the upper layer, such that the extent of the said curved surfaces of the tubes which acts to support the person thereon is dependent upon the degree of inflation of the lower inflatable layer, and the upper surface of the upper layer includes means for permitting limited air bleeding therethrough.

2. An inflatable support according to claim 1, wherein the upper inflatable layer takes the form of a plurality of air passages, each air passage comprising a series of transverse tubes supplied by a common header tube located at the sides of the support, alternate transverse tubes communicating with one header tube, and intervening transverse tubes communicating with the other header tube.

3. An inflatable support according to claim 1, comprising a source of compressed air supplying air to the upper layer through a conduit which branches to separate inlets of the different air passages in the upper layer, and a switching device to cyclicly switch the air supply from one branch to the other, wherein deflation of a passage is effected by cutting off the air supplied through that passage.

4. An inflatable support according to claim 1, wherein the means for permitting limited air bleeding comprises air bleed apertures arranged non-uniformly over the upper surface of the upper layer to provide air bleeding from selected areas thereof.

5. An inflatable support according to claim 1, including inflation equipment comprising a source of compressed air supplying air to separate conduits to the lower and upper inflatable layers, the conduit to the upper layer branching to separate inlets of the different air passages in the upper layer, and a switching device being provided to cyclicly switch the air supply from one branch to the other.

6. An inflatable support according to claim 5 wherein a variable pressure reduction valve is supplied in the conduit to the lower layer to enable the firmness of the underlying layer to be varied independently of the support provided by the upper layer.

7. An inflatable support according to claim 1 comprising a source of compressed air supplying air to the upper layer through a conduit which branches to separate inlets of the different air passages in the upper layer, and a switching device to cyclicly switch the air supply from one branch to the other, the switching device including means to vary the cycle length.

8. An inflatable support according to claim 1 comprising a source of compressed air supplying air to the upper layer through a conduit which branches to separate inlets of the different air passages in the upper layer, and a switching device to cyclicly switch the air supply from one branch to the other, the switching device comprising a motor driven valve.

9. An inflatable support according to claim 8 wherein said motor speed is variable so as to vary the cycle frequency.

* * * * *